United States Patent [19]

Zamboni

[11] 4,372,617

[45] Feb. 8, 1983

[54] ICE EDGER FOR ICE RESURFACING MACHINE

[75] Inventor: Frank J. Zamboni, Paramount, Calif.

[73] Assignee: Frank J. Zamboni & Co., Paramount, Calif.

[21] Appl. No.: 222,482

[22] Filed: Jan. 5, 1981

[51] Int. Cl.[3] ..... E01H 5/12

[52] U.S. Cl. ..... 299/24; 172/782; 172/815

[58] Field of Search ..... 299/24, 36; 404/118; 37/13, 41; 172/815, 782, 784

[56] References Cited

U.S. PATENT DOCUMENTS

| | | | |
|---|---|---|---|
| 1,466,464 | 8/1923 | Beatty | 172/782 |
| 2,763,939 | 9/1956 | Zamboni | 299/24 X |
| 3,231,991 | 2/1966 | Wandscheer et al. | 172/782 X |
| 3,479,755 | 11/1969 | Schropp | 172/784 X |
| 4,208,812 | 6/1980 | Brownly | 172/784 X |

OTHER PUBLICATIONS

Zamboni Company Literature, 2 pages.

*Primary Examiner*—Ernest R. Purser
*Attorney, Agent, or Firm*—K. H. Boswell; Edward D. O'Brian

[57] ABSTRACT

An edging apparatus for an ice resurfacing machine includes a guide operatively attaching to one of the side edges of the machine which is capable of being extended from the side of the machine such that it can contact an upright surface as, for example, a rink wall or a dasher board extending around the perimeter of an ice rink. Associated with the guide is an ice shaving blade which is capable of extending in a vertical direction upwards and downwards between a shaving position wherein it can contact the ice surface and shave the surface and a non-shaving position wherein it is lifted upwards from the ice surface. The guide is interposed between the end of the edge of the blade and the dasher board or the rink wall such that it is impossible to catch the end of the blade in the wall or dasher board yet it is possible to correctly position the end of this blade very close to the wall or dasher board allowing shaving of the ice surface to a point almost immediately adjacent to the wall or dasher board. The apparatus includes appropriately connecting members allowing for pivotally connecting the guide and ice blade to the machine such that they can be extended away from the side edge of the machine during edging but retracted back to the machine during other operations of the machine.

10 Claims, 7 Drawing Figures

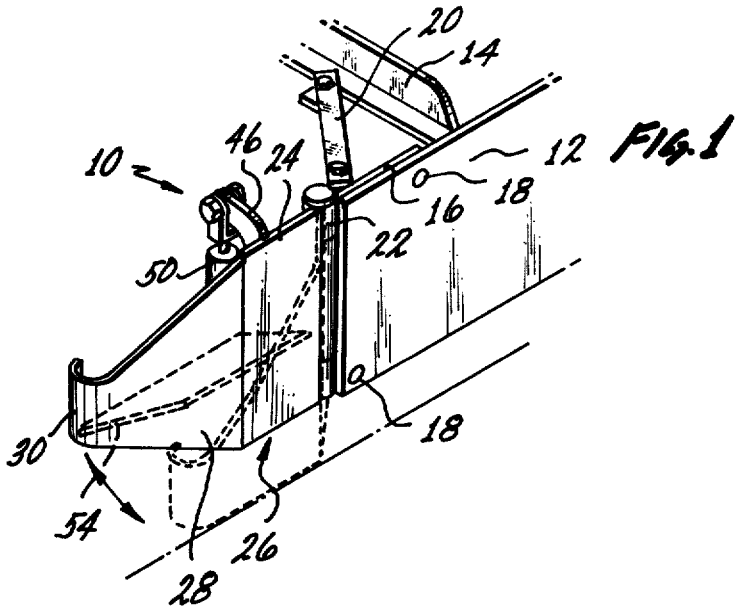
Fig. 1
Fig. 2
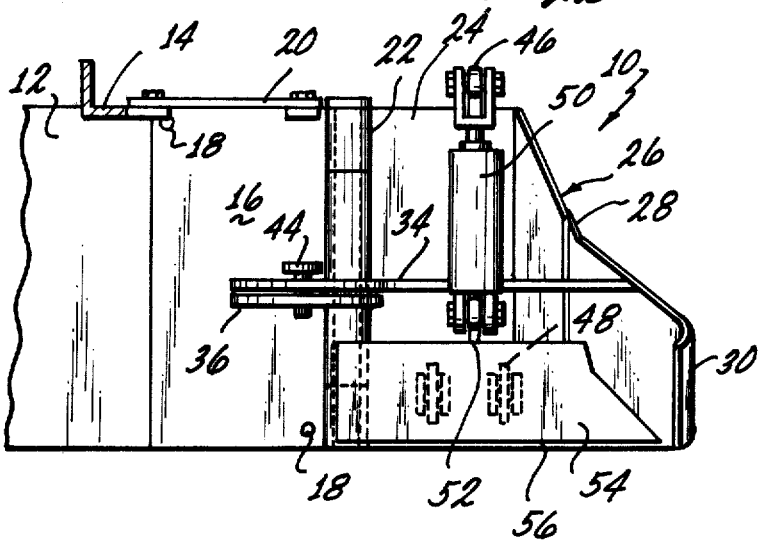

10
32
6
24
26
7
28
62
30
18
12
18
50
46
7
22
16
56
6
38
54
20
36
34
14
42
44

32
26
30
56
60
54

46
10
20
50
24
12
44
34

26
36
48
58
56
54
52
60

ICE EDGER FOR ICE RESURFACING MACHINE

BACKGROUND

This invention is directed to an apparatus for use on ice resurfacing machines which allows for shaving or planing of the surface of the ice immediately adjacent to the dasher board or rink wall of an ice rink. The invention allows for extension and retraction of the apparatus between working and non-working positions as well as movement of an ice blade between shaving and non-shaving positions.

In ice rink facilities designed for ice sports such as skating, ice shows and hockey games it has been found desirable to periodically resurface the ice surface. The blades on the different types of skates used on the ice surface are capable of gouging and pitting the ice surface as well as forming a snow which piles up on the ice surface. It is inevitable that this occurs because of the sharpness of the blades on the ice skates.

Machines have been developed such as those produced by the Zamboni Company Inc., the assignee of this application, which are capable of resurfacing the ice surface. In resurfacing the ice surface the ice is planed to level and smooth it, the snow is removed, the surface is washed and finally a layer of water is coated on the ice which immediately refreezes to form a new smooth ice surface. As currently in use these machines are self propelled vehicles which are equipped with a sled or conditioner which performs the necessary resurfacing functions. The conditioner carries the ice shaving blade, a snow removal plow normally the form of a helical screw, washing jets and squeegee and the applicator for laying a water film to form fresh ice. The conditioner rides on the surface of the ice on runners placed on the left and right hand side of the conditioner. It is desirable to place as much weight as possible on the conditioner so that the blade may plane surface the ice as smoothly and level as possible. The runners supporting the conditioner therefore must support a substantial portion of the weight of the machine.

The conditioner is constructed such that the runners are the outer most components. The ice blade extends between the runners. Other components such as the helical screw also extends between the runners and in fact the bearings for the helical screws are mounted on the inside of the runners. Because of this manner of construction it is not possible for the main ice blade of the machine to extend beyond the side edges of the machine. This limits exactly how close the machine can resurface the ice next to the side wall or dasher boards of an ice rink. Normally it is impossible to come any closer than 2" or 3" to these dasher boards or rink walls.

Because of the inability of the ice resurfacing machine itself to actually resurface the ice immediately adjacent to the rink wall or dasher board an ice lip can slowly build up around the perimeter of the ice rink. This lip can be dangerous to skaters in that on entering the ice it forms an unseen step which they must negotiate. Further the ice lip interferes with the function of the ice blade on the ice resurfacing machine. If uncorrected the lip could conceivably develop into the total ice surface assuming a concave shape. This is undesirable because of natural tendency of the skaters and the like to slide toward the center of this shape.

If a lip around the perimeter of the ice rink has been allowed to build up to any significant extent, and if the operator of an ice resurfacing machine attempts to shave this lip with the ice resurfacing machine itself, a further problem develops in that the concavity of the ice surface caused by the lip allows only the ends of the ice blade to engage the ice surface and as such scarring of the ice by the ends of the ice blades is possible. The surface of the ice underneath the center of the ice blade will not be planed or shaved because of the contact of the ice blade only at its ends.

At present there is a commercial machine which is capable of resurfacing the edge of the ice around its perimeter. This machine requires an operator to walk behind the machine for its operations. Aside then from having to purchase a separate machine, use of this machine requires expenditure of labor time. Since the operator must walk behind the machine use of this machine is time consuming and results in additional down time of the ice rink in addition to that necessitated by the use of the ice resurfacing machine itself.

In order to overcome the obvious disadvantages of the above noted edging machine, the assignee of this application has previously used an edger which is bolted onto its ice resurfacing machines. While this edger does away with the necessity of having an operator following the machine around on foot, it has certain limitations which preclude its universal use and acceptance. This edger requires it to be bolted off and on to the conditioner of an ice resurfacing machine. As such it must be considered as a semi-permanent fixture at best. Since it is somewhat time consuming to bolt and unbolt this edger, the operator of the machine must always contend with its presence on one side of the machine. The presence of this type of semi-permanent edger must be considered in moving the ice resurfacing machine onto and off the ice rink as well as within the storage area used for parking of the ice resurfacing machine. The blade of this edger must be manually raised and lowered by undoing a locking bolt and resetting the blade depth with a set of screws. Since the blade of the edger will only want to be engaged when actually edging the ice rink it is necessary for the operator to hand attach and detach the blade before and after each edging operation. This is time consuming and very inconvenient.

BRIEF SUMMARY OF THE INVENTION

In view of the above it is considered that there exists a need for an edging apparatus for an ice resurfacing machine which is capable of being quickly placed into working position, edging around the perimeter of an ice rink, and then returning to a storage position. Further, it is considered that there exists a need for an edging apparatus for an ice resurfacer that is capable of having the ice shaving blade engaged via a mechanical means by the operator of the ice resurfacing machine while the operator is sitting at the controls of this surfacing machine.

In view of the above, it is therefore an object of this invention to provide an edging apparatus for an ice resurfacing machine which fulfills the above noted needs. Additionally it is an object of this invention to provide such an edging apparatus which is simple in construction and therefore not susceptible to mechanical failure yet is engineered such that it is capable of performing its necessary edging function in a facile manner. Further, it is an object to provide an edging apparatus which is adaptable to new machines coming off of the production line as well as existing machines already in the consumers hand.

These and other objects as will become obvious from the remainder of this specification are achieved in an edging apparatus for use on an ice surface modifying machine of the type which includes an ice modifying component capable of shaving an ice surface which comprises: a guide means, at least a portion of said guide means capable of being located adjacent to and following the contours of a projecting surface which is located next to and extends above an ice surface; an ice shaving means including an ice shaving edge, said ice shaving means operatively associated with said guide means, at least said shaving edge moveable in a vertical direction with respect to said ice surface between a shaving position wherein said shaving edge is capable of contacting and shaving said ice surface and a non-shaving position wherein said shaving edge is lifted vertically to a position above said ice surface, at least in said shaving position one of the ends of said shaving edge being located in close association with said portion of said guide means capable of being located adjacent to said projecting surface; pivoting means operatively connecting said guide means and said ice shaving means to one of the side edges of said machine so as to allow said guide means and said ice shaving means to pivot between an extended position wherein at least said portion of said guide means capable of being adjacent to said projecting surface is extended outwardly from the plane of the side edge of said machine and a retracted position wherein both of said guide means and said ice shaving means do not essentially extend beyond the plane of said side edge; positioning means reversibly retaining said guide means and said ice shaving means in said retracted position and said extended position.

In the preferred embodiment of the invention the ice shaving means will include an ice blade and a bracket. The ice blade has the shaving edge located thereon and the bracket operatively attaches to the guide means and is capable of moving in concert with the guide means between the extended and retracted position. Further, a blade elevating means connecting the bracket to the guide means is included and is capable of elevating or depressing the shaving edge of the blade. This elevating means is preferredly a hydraulic cylinder.

Preferredly the guide means includes a guide member having an extending portion and a following portion which are joined together at an angle. The extending portion is mounted to the machine at a hinge which allows pivoting of the guide member between the extended and retracted positions.

Additionally the preferred embodiment can include a snow plow associated with the ice blade for directing ice shavings towards the ice resurfacing machine. The guide member is locked in the extended and the retracted positions respectively by including first and second positioning members. One of these is attached to the machine and one is attached to the guide member and they can be locked together with use of a locking pin which passes through holes appropriately located in their surfaces.

BRIEF DESCRIPTION OF THE DRAWINGS

This invention will be better understood when taken in conjunction with the drawings wherein FIG. 1 is an isometric view showing the ice edging apparatus of the invention as it is mounted to an ice edging machine, only a portion of which is shown, and including a first spacial position in solid lines and a second spacial position in phantom lines;

FIG. 2 is a front elevational view of the ice edging apparatus of FIG. 1 showing it in a different view from that seen in FIG. 1;

Figure 3:
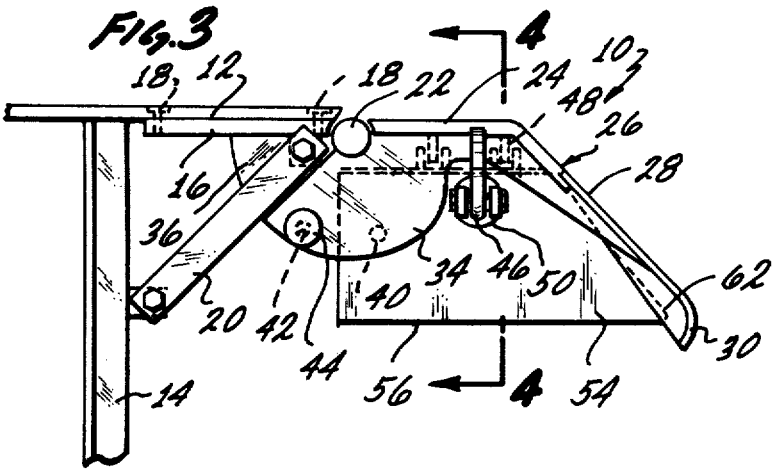
FIG. 3 is a top plan view of the edging apparatus and portion of the ice resurfacing machine as shown in solid lines in FIG. 1.

The invention described in this specification and shown in the drawings utilizes certain principles and or concepts as are set forth in the claims appended to this specification. Those skilled in the arts to which this invention pertains will realize that these principles and or concepts are capable of being expressed in embodiments differing from the exact embodiments herein depicted for illustrative purposes. For this reason, this invention is to be construed as only being limited by the claims and is not to be construed as being limited to the exact embodiments depicted herein.

DETAILED DESCRIPTION

The ice edger 10 of the invention attaches to the conditioner or sled of which only its left side panel 12 and one traverse member 14 are illustrated in the drawing. The conditioner in turn fits underneath an ice resurfacing machine not numbered or shown. The side panel 12 is a vertical extension above the runner of the conditioner of the ice resurfacing machine. The outside of side panel 12 is therefore the outermost plane which exists on the conditioner portion of the ice resurfacing machine. Normally, the operator of the ice resurfacing machine sits at the left rear of the machine and therefore the ice edger 10 is preferredly placed on the left side of the ice resurfacing machine where it is in view of the operator such that he can appropriately watch both it and the outer perimeter of the rink to insure edging the ice surface as close to this outer perimeter as possible.

The ice edger 10 is mounted to the side panel 12 by appropriately fixing a plate 16 on the inside of the side panel 12 by bolting the plate 16 to the side panel 12 with a plurality of bolts 18 whose heads are countersunk into the side panel 12 such that they do not extend from it. The plate 16 is then strengthened by attaching an obliquely extending support 20 between it and transverse member 14 of the conditioner using appropriate L shaped brackets not numbered. Welded along the leading edge of plate 16 is a portion of a hinge 22. The remaining portions of the hinge 22 are formed as a part of the extending portion 24 of guide member 26. This allows guide member 26 to pivot about the hinge 22 between the positions shown in solid and phantom lines in FIG. 1 and also seen in FIG. 3 and FIG. 5.

Figure 5:
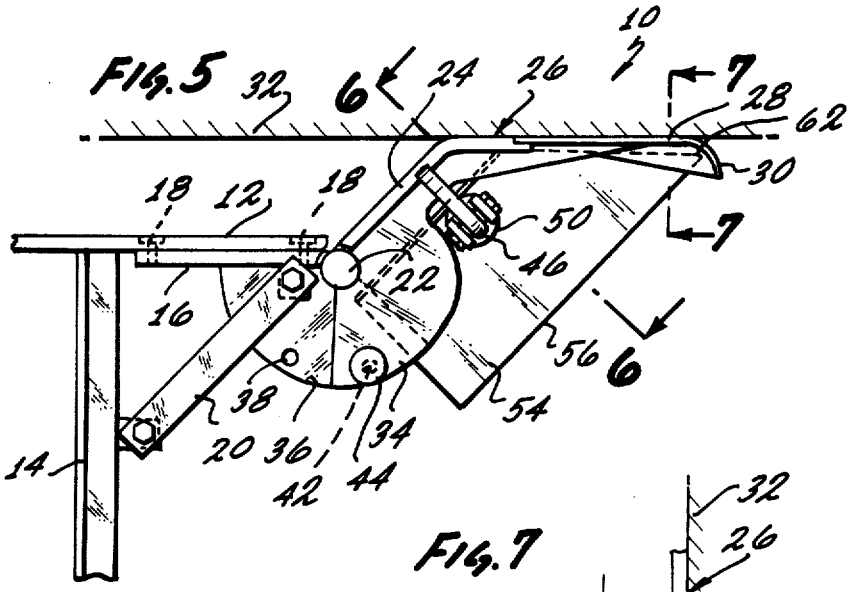
FIG. 5 is a top plan view of the edging apparatus and portion of the ice resurfacing machine as shown in phantom lines in FIG. 1.
Figure 7:
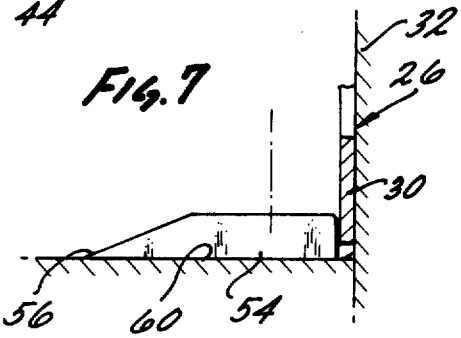
FIG. 7 is a front elevational view in partial section about the line 7—7 in FIG. 5.

The guide member 26 includes a following portion 28 which is integrally formed with the extending portion 24 and intersects it at an angle. The leading edge 30 of the following portion 28 is slightly curved such that the guide member 26 does not present any sharp or pointed surfaces. As seen in FIG. 5 the following portion 28 of the guide member is capable of abutting against and following the contour of a vertical surface such as dasher board 32. Normally the dasher boards 32 would be constructed of a material such as wood, plastic or fiberglass which is susceptible to puncture, scraping or the like if contacted with any sharp or protruding edges. The guide member 26 is preferredly formed out of steel or other suitable metal and thus could easily damage the dasher board 32. By curving the leading edge 30 essentially as depicted in the figures, the operator of the ice resurfacing machine is assured that the guide member will not scar, puncture or otherwise damage the dasher board 32.

Extending on the inside of guide member 26 is a first positioning member 34 which is horizontally oriented and welded to the insides of both the extending 24 and following portions 28 of the guide member 26. The positioning member 34 therefore can serve two functions. Since it is placed perpendicular to the vertically oriented surfaces of the guide member 26 it serves to form a backbone for these and strengthen them. Further, it interacts with the other positioning member 36 which is fixedly attached to the plate 16 to position the ice edger 10 between a retracted position as shown in the solid lines of FIG. 1 and in FIG. 3 and in phantom lines of FIG. 1 and in FIG. 5.

The positioning member 36 is shaped as an arcuate sector. A portion of the positioning member 34 is also shaped as an arcuate sector. These arcuate shapes overlap as is seen in the figures. The positioning member 36 includes at least two holes passing vertically through its surface. One of these holes, seen in FIG. 5, is identified by the numeral 38 and the other of the holes, hidden from view, is shown in dotted lines and identified by the numeral 40 in FIG. 3. A single hole 42 passes vertically through positioning member 36. A locking pin 44 is used to lock the two positioning members 34 and 36 together by passing a locking pin through hole 42 into either hole 38 or 40. This locks the guide member 26 in either its extended or retracted position.

Attached to the upper portion of extending portion 24 is a bracket 46. Attached near the lower part of extending portion 24 is a bracket 48. The upper end of hydraulic cylinder 50 is attached to bracket 46 and the lower end is attached to blade bracket 52. Blade bracket 52 in turn is attached to bracket 48. These attachments all utilize locking pins, not separately numbered, which allows for rotation about each attachement point. The hydraulic cylinder 50 includes appropriate fluid inlet and outlet nipples, not shown or identified in the drawings allowing for remote control of the hydraulic cylinder by the operator of the ice resurfacing machine.

Figure 4:
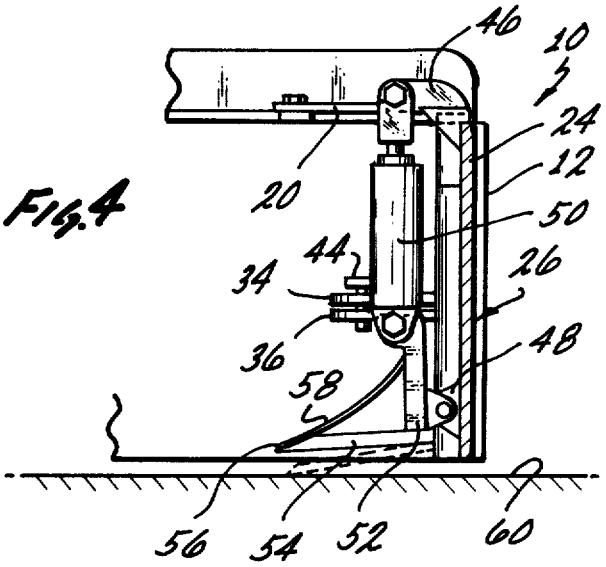
FIG. 4 is a side elevational view in partial section of about the line 4—4 of FIG. 3.
Figure 6:
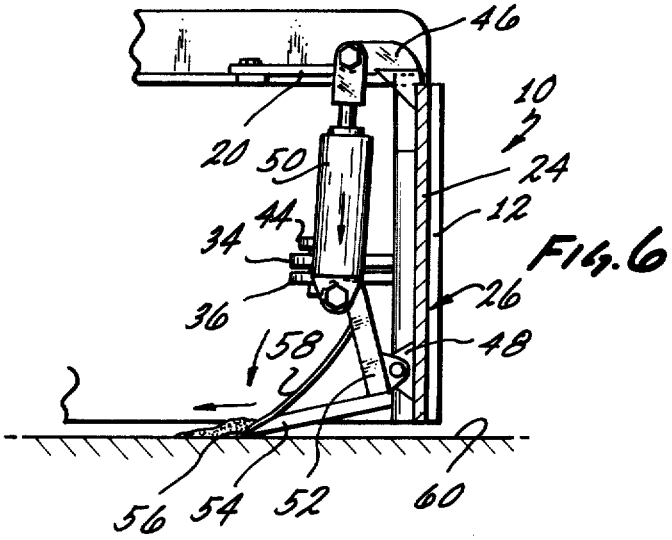
FIG. 6 is a side elevational view in partial section about the lines of 6—6 of FIG. 5 which shows the ice blade in a working position.

A blade 54 is attached to blade bracket 52 via appropriate counter set bolts not shown or numbered. The blade 54 includes a shaving edge 56. Extending between the shaving edge 56 and the blade bracket 52 is a snow plow 58. The shaving edge 56 of the blade 54 can be appropriately raised or lowered between a non-shaving position as shown in FIG. 4 and a shaving position as shown in FIG. 6. In the shaving position shown in FIG. 6 the shaving edge 56 contacts the ice surface 60 and shaves or removes a small increment of it such as, for example, 1/32nd of an inch of ice. The shaving edge is capable of taking off a larger increment of ice such as, for example, ¼ of an inch but with approriate normal repetitive use of the ice edger 10 it will normally only be required to take a smaller cut such as the 1/32nd cut. Because of the ease of use of the ice edger 10 the edge of the ice surface 60 can be appropriately conditioned at periodic intervals thus preventing an unusually large build up of a concave edge on the ice surface. Should the ice edger 10 be used on an ice surface which has been allowed to build up a distinctive edge, of course, it might be preferred to take a larger cut such as the ¼th inch cut. In any event, the depth of a cut possible using the ice edger 10 is easily controlled by the operator of the ice resurfacing machine via appropriate hydraulic controls linked to the hydraulic cylinder 50.

As the shaving edge 56 of the blade 54 becomes dull with repetitive use, it can be easily exchanged by simply demounting it from the blade bracket 52 and replacing it with an alternate blade 54 or simply resharpening the same blade 54. By incorporating the snow plow 58 on the blade 54, the snow formed in shaving the ice is quickly moved toward the conditioner of the ice resurfacing machine such that the snow removal screw of the ice resurfacing machine can easily dispose of this snow in the normal manner it does for snow formed by the main blade of the conditioner.

As is evident from viewing FIG. 5, the outside end 62 of the blade 54 is located adjacent to the following portion of the guide member 26. This allows placement of this end 62 very close to the dasher board 32 yet prevents this end 62 from engaging the dasher board 32 by interposing the guide member 26 between it and the dasher board. As can be seen in FIG. 5, during actual operation of the ice edger 10 the guide member 26 is positioned such that the following portion 28 of the guide member 26 is in fact parallel with the side panel 12 of the ice resurfacing machine. This placement is achieved by appropriate location of the hole 42 with respect to the hole 40.

In the embodiment shown in the figures the guide member 26 and the blade 54 are easily moved from the retracted position to the extended position by the operator simply pulling the locking pin 44 and swiveling the guide member 26 about the hinge 22. While this is the preferred embodiment it is immediately apparent that a second hydraulic cylinder, not shown or numbered could be incorporated into the ice edger 10 such that its operation moved the guide member 26 and the blade 54 attached thereto between the extended and retracted positions. Further, while it is preferred to incorporate the hydraulic cylinder 50 to raise and lower the blade 54 between the shaving and non-shaving positions a manually operated linkage similar to the linkage provided by positioning members 34 and 36 could be utilized to control the position of the blade 54. The hydraulic cylinder 50 is, however, preferred in that it allows for a large variability of depth of cut of the shaving edge 56.

I claim:

1. An edging apparatus for use on an ice surface modifying machine of the type which includes an ice modifying component capable of shaving an ice surface which comprises:

a guide means, at least a portion of said guide means capable of being located adjacent to and following the contours of a projecting surface which is located next to and extends above an ice surface;

an ice shaving means including an ice shaving edge, said ice shaving means operatively associated with said guide means with at least said ice shaving edge formed as a structure independently of said guide means, at least said shaving edge movable in a vertical direction with respect to said ice surface between a shaving position wherein said shaving edge is capable of contacting and shaving said ice surface and a non-shaving position wherein said shaving edge is lifted vertically to a position above said ice surface, at least in said shaving position one of the ends of said shaving edge being located in close association with said portion of said guide means capable of being located adjacent to said projecting surface;

pivoting means operatively connecting said guide means and said ice shaving means to one of the side edges of said machine so as to allow said guide means and said ice shaving means to pivot between an extended position wherein at least said portion of said guide means capable of being adjacent to said projecting surface is extended outwardly from the plane of the side edge of said machine and a retracted position wherein both of said guide means and said ice shaving means do not essentially extend beyond the plane of said side edge;

positioning means reversibly retaining said guide means and said ice shaving means in said retracted position and said extended position.

2. The apparatus of claim 1 including connecting means operatively attaching said ice shaving means to said guide means and including said ice shaving means being capable of moving in concert with said guide means between said extended position and said retracted position.

3. The apparatus of claim 2 wherein said ice shaving means includes an ice blade and a blade bracket means, said ice blade having said shaving edge located thereon;

said ice blade fixedly attaching to said blade bracket means, said blade bracket means movably connected to said guide means;

blade elevating means connecting said blade bracket means to said guide means and capable of elevating or depressing said shaving edge of said blade between said non-shaving position and said shaving position.

4. The apparatus of claim 3 wherein said blade bracket means comprises a blade bracket pivotally mounted to said guide means;

said elevating means comprises a hydraulic cylinder operatively connected between said blade bracket and said guide means, said hydraulic cylinder capable of pivoting said blade bracket on said guide means.

5. The apparatus of claim 1 wherein said guide means comprises a guide member, said pivot means comprises a hinge connecting said guide member to said side edge of said machine, said guide member capable of pivoting about said hinge between said extended position and said retracted position.

6. The apparatus of claim 5 wherein said guide member includes an extending portion and a following portion, said extending and said following portions joined together and intersecting each other at an angle;

said following portion capable of abutting against and sliding against said projecting surface.

7. An edging apparatus for use on an ice surface modifying machine of the type which includes an ice modifying component capable of shaving an ice surface which comprises:

a guide means, at least a portion of said guide means capable of being located adjacent to and following the contours of a projecting surface which is located next to and extends above an ice surface;

an ice shaving means including an ice shaving edge, said ice shaving means operatively associated with said guide means with at least said ice shaving edge formed as a structure independently of said guide means, at least said shaving edge movable in a vertical direction with respect to said ice surface between a shaving position wherein said shaving edge is capable of contacting and shaving said ice surface and a non-shaving position wherein said shaving edge is lifted vertically to a position above said ice surface, at least in said shaving position one of the ends of said shaving edge being located in close association with said portion of said guide means capable of being located adjacent to said projecting surface;

pivoting means operatively connecting said guide means and said ice shaving means to one of the side edges of said machine so as to allow said guide means and said ice shaving means to pivot between an extended position wherein at least said portion of said guide means capable of being adjacent to said projecting surface is extended outwardly from the plane of the side edge of said machine and a retracted position wherein both of said guide means and said ice shaving means do not essentially extend beyond the plane of said side edge;

positioning means reversibly retaining said guide means and said ice shaving means in said retracted position and said extended position;

said guide means comprises a guide member, said pivot means comprises a hinge connecting said guide member to said edge of said machine, said guide member capable of pivoting about said hinge between said extended position and said retracted position;

said guide member includes an extending portion and a following portion, said extending and said following portions joined together and intersecting each other at an angle;

said following portion capable of abutting against and sliding against said projecting surface;

connecting means operatively attaching said ice shaving means to said guide means and including said ice shaving means being capable of moving in concert with said guide means between said extended position and said retracted position;

an ice blade and a blade bracket means, said ice blade having said shaving edge located thereon;

said ice blade fixedly attaching to said blade bracket means, said blade bracket means movably connected to said guide means;

blade elevating means connecting said blade bracket means to said guide means and capable of elevating or depressing said shaving edge of said blade between said non-shaving position and said shaving position;

said blade bracket means comprises a blade bracket pivotally mounted to said guide means;

said elevating means comprises a hydraulic cylinder operatively connected between said blade bracket and said guide means, said hydraulic cylinder capable of pivoting said blade bracket on said guide means;

said ice blade extending from said following portion of said guide member toward said side edge of said machine.

8. The apparatus of claim 7 including snow plow means operatively associated with said ice blade and capable of directing ice shavings removed from said ice surface by said ice blade away from said following surface and toward said side edge of said machine.

9. The apparatus of claim 8 wherein said positioning means includes a first positioning member and a second positioning member, said first positioning member fixedly attaching to said machine, said second positioning member fixedly attaching to said extending portion of said guide member, said second positioning member movable with respect to said first positioning member as said guide member pivots about said hinge;

locking means operatively associated with said first and said second positioning members to fixedly locate said first and said second positioning members in at least two positions corresponding to said extending position and said retractive positions.

10. The apparatus of claim 9 wherein said locking means comprises one of said first or said second positioning members having at least one hole and the other of said first or said second positioning members having at least two holes;

a locking pin capable of passing through said holes on said first and said second positioning members to fixedly position said first and said second members with repect to one another when a hole in one of said first or said second positioning members is aligned with a hole in the other of said first or said second positioning members.

* * * * *